United States Patent [19]

Szu

[11] 4,197,510

[45] Apr. 8, 1980

[54] ISOCHRONOUS CYCLOTRON

[75] Inventor: Harold H. Szu, Potomac, Md.

[73] Assignee: The United States of America as represented by the Secretary of the Navy, Washington, D.C.

[21] Appl. No.: 918,241

[22] Filed: Jun. 23, 1978

[51] Int. Cl.[2] ..... H05H 7/04; H05H 13/02

[52] U.S. Cl. ..... 328/234; 313/62

[58] Field of Search ..... 328/234; 313/62

[56] References Cited

U.S. PATENT DOCUMENTS

| | | | |
|---|---|---|---|
| 3,427,557 | 2/1969 | Speciale | 328/234 |
| 3,459,988 | 8/1969 | Russell | 328/234 X |

OTHER PUBLICATIONS

Szu, "Transactions on Nuclear Science,", Jun., 1977, vol. NS-24, #3, cover page.

*Primary Examiner*—Robert Segal

*Attorney, Agent, or Firm*—R. S. Sciascia; Philip Schneider; William C. Daubenspeck

[57] ABSTRACT

A solenoid comprising several, discrete, coaxial, circular, superconducting coils provides a magnetic field which decreases radially to an absolute minimum intensity to focus the ions as they are accelerated to the end of the non-relativistic velocity range. As the ions are further accelerated to relativistic velocities, the magnetic field increases radially from the absolute minimum intensity to compensate for the relativistic increase in mass. The revolving ions are accelerated by repeated passage through an electric field which is established in radially-directed resonator horns. The accelerating structure and the associated electric field reinforce the focusing provided by the radially-increasing magnetic field.

7 Claims, 7 Drawing Figures

ISOCHRONOUS CYCLOTRON

BACKGROUND OF THE INVENTION

This invention relates in general to particle accelerators and especially to cyclotrons for accelerating heavy ions. More particularly, the invention relates to an isochronous cyclotron in which superconducting coils provide a radially-decreasing magnetic field to focus the ions at non-relativistic velocities and a radially-increasing field to focus the ions at relativistic velocities.

The conventional cyclotron comprises spaced apart coaxial magnetic pole pieces and a dee electrode structure disposed therebetween. The dee structure is energized to provide an alternating electric field at right angles to the magnetic field whereby charged particles introduced near the center of the system are accelerated. Because of the magnetic field, the particles describe a curvilinear orbit which expands as the particles gain energy by repeated passage through the electric field. The fundamental cyclotron principle requires that the time for one revolution of a particle in the magnetic field be constant and independent of particle energy. Thus the magnetic field, the alternating electric field, and the frequency thereof, may be held at fixed values throughout the period of particle acceleration. However, because of two factors serious disadvantages occur in conventional cyclotrons when it is desired to accelerate particles to extremely high energies. First, the maximum magnetic-field strength supplied by the iron pole pieces is limited to approximately 2.2 K gauss. Consequently, high-energy ions have large-radius orbits which require pole pieces of great size and weight. The second problem is related to the increase in mass experienced by the particles as they are accelerated into the relativistic range of velocities and to the effect this phenomena has on the orbital frequency and orbital stability of particles. At non-relativistic velocities particles may be accelerated in stable, isochronous orbits by a magnetic field which decreases slowly in intensity from the center of the system outward. As the particles are further accelerated to relativistic velocities in a radially-decreasing field, the relativistic mass increase reduces the particles velocity, thereby changing the orbital frequency of the particle and causing the particles to arrive at the accelerating gaps out of phase with the accelerating electric field. One means of compensating for this effect is to vary the frequency of the alternating electric field as a given pulse of particles is accelerated. Althrough a satisfactory phase relationship is established, this technique severely restricts the total beam current.

A second means of compensating for the relativistic mass increase of the particles is to provide a magnetic field which increases in intensity as the particles move outward from the center of the system. However, in the past the radially-increasing fields have adversely affected the stability of the particle orbits.

SUMMARY OF THE INVENTION

The foregoing disadvantages are overcome in a two-stage isochronous cyclotron in which a superconducting solenoid produces a magnetic field which has an absolute-minimum intensity (the field increases in all directions) at a circle of radius r° in the orbital plane. This radius r° corresponds to the radius at which relativistic velocities are reached. In the first stage the ions, which are injected at non-relativistic velocities and at a radius less than r°, are focused by the radially-decreasing field as they are accelerated to the absolute-minimum-field-intensity circle. As the ions are accelerated beyond the absolute-minimum-field-intensity circle, the radially-increasing magnetic field compensates for the mass increase due to relativistic effects so as to maintain the constant orbital frequency. The ions are accelerated in both stages by passage through an electric field which is established in radially-directed resonator horns by a microwave power supply. The resonator horns are shaped to provide a radially-increasing electric field in the second stage. This radially-increasing electric field operates synergistically with the radially-increasing magnetic field to provide radial focusing in the second stage.

The various species, tunable to an identical cyclotron frequency $\Omega(r°)$, are isochronously accelerated along an exact and universal orbit by the present cyclotron. Only the time rate of an ion traveling on this universal orbit depends on the species (i.e., depends on the charge-to-mass ratio). For a given magnetic-field intensity, an ion having a heavier rest mass will be accelerated to a higher kinetic energy than an ion having a lighter rest mass. The heavier ion will also result in a smaller radiation loss. Thus the heavier the rest mass of the ion the more advantageous the present cyclotron will be. In addition the superconducting solenoid provides a greater magnetic-field intensity than the conventional ion-core magnet. This reduces the cyclotron radius necessary to attain a particular ion energy and the size and weight of the associated apparatus.

These and other advantages of the present invention will become clear in light of the following description of the preferred embodiment when considered in conjunction with the accompanying figures wherein:

DESCRIPTION OF THE PREFERRED EMBODIMENT

A detailed mathematical explanation of the present invention is found in IEEE Transactions on Nuclear Science, Vol. NS-24, No. 3, June 1977, entitled "A Football Coil, a Device to Produce Absolute Minimum Magnetic Field and an Isochronous Cyclotron for Heavy Ions" by Harold Szu. This description of the preferred embodiment will be limited, in general, to the novel features of the present cyclotron. A person skilled in the art will recognize that other elements such as the ion source, ion injection and extraction means, vacuum equipment and the like which are required for a particle accelerator may be of conventional design and suitable structure for these components is well known.

In the present cyclotron, the magnetic field $\underset{\sim}{B}^E$ for focusing the ions is provided by an electric solenoid consisting of several, discrete, circular, coaxial loops (coils) of superconducting material. The superscript E distinguishes this external field from an internal field produced by the accelerated particles and identified by a superscript I. The design of these superconducting coils and the associated cryostat apparatus is well within the present superconductor technology, and in fact can be borrowed directly from the plasma fusion technology. It is noted that superconducting-magnet technology provides a stronger magnetic field than an iron-core structure of comparable size and has a much larger maximum field limitation. This allows for a reduction in the overall size of the particle accelerating device and permits acceleration to greater energies when compared to iron-core structures.

Figure 1:
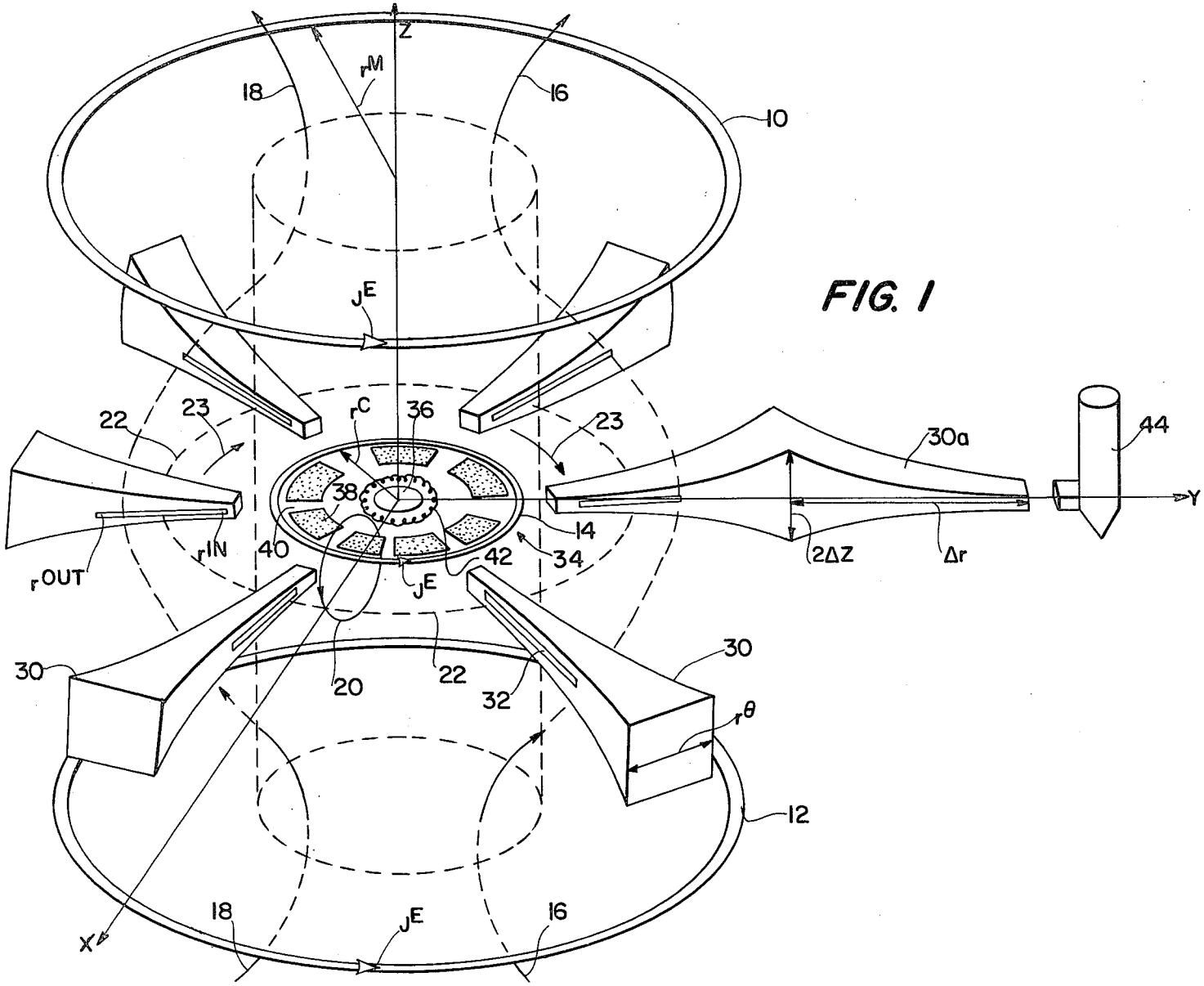
FIG. 1 is a perspective view illustrating a cyclotron according to the present invention.

For purposes of illustration, the simplest solenoid consisting of three coils is shown in FIG. 1. End coils 10 and 12 having the identical radius $r^M$ are located equidistant from central coil 14 having a radius $r^C$, where $r^C$ is less than $r^M$. When a constant current $J^E$ flows through the end coils 10 and 12, the well known mirror field $\underset{\sim}{B}^M(r,z)$, (where r, $\theta$, and z are cylindrical co-ordinates and $\underset{\sim}{B}^M(r,z)$ indicates that the field is independent of $\theta$, i.e., symmetrical with respect to the z-axis) is produced inside the coils as indicated by dashed lines 16 and 18. The center of this field is a saddle point, that is, an axially minimal $\underset{\sim}{B}^M$ (o,z) on a radially maximal $\underset{\sim}{B}^M(r,z)$. If constant current $\underset{\sim}{J}^E$ is introduced into the central coil 14 an additional field $\underset{\sim}{B}^C(r,z)$ indicated by dashed line 20 is produced. This field increases in the central plane (the plane defined by z=0) as r increases toward $r^C$ from the center of the loop and decreases as r increases beyond $r^C$ according to Ampere's law. Since the magnetic field line wraps around the electrical conductor, the direction of the magnetic field $\underset{\sim}{B}^C$ produced by the central loop 14 is reversed from the magnetic field $\underset{\sim}{B}^M$ produced by the end loops 10 and 12. As the magnetic field $\underset{\sim}{B}^C$ decreases outside the central loop 14, the net magnetic field $\underset{\sim}{B}^E$ ($=\underset{\sim}{B}^C+\underset{\sim}{B}^M$) outside the central loop becomes an absolute minimum ($\underset{\sim}{B}^E$ increases in all directions) over a circle (dashed line 22) in the central plane of radius r° where r° is greater than $r^C$ but less than $r^M$. Thus the net external magnetic field $\underset{\sim}{B}^E$ is radially decreasing for r less than r° in the central plane, radially increasing for r greater than r° in the central plane, and axially increasing in either direction (±z) at r° in the central plane.

The focusing provided by the solenoid combines the concept of "weak focusing" as used in the conventional cyclotron in which a radially-decreasing magnetic field is employed with the Fermi concept of magnetic mirroring. As in all cyclotrons, the Lorentz force, $\rho\underset{\sim}{V} \times \underset{\sim}{B}^E=(F_r^E, F_\theta^E, F_z^E)$ where $\rho$ is the charge density (nq, the number times the charge q) and $\underset{\sim}{V}$ is the fluid velocity of the ion beam, focuses the ions into the collective orbit ($\bar{r}$, $\bar{\theta}$, $\bar{z}$), while a boosting electric field $\underset{\sim}{E}^P$ produced by a power supply accelerates the ions. The novel accelerating structure of the present cyclotron which will be described hereinafter is also designed to reinforce the focusing provided by the magnetic field $\underset{\sim}{B}^E$, by providing a radially increasing $\underset{\sim}{E}^P(r)$.

In the present cyclotron there are two stages of acceleration. The first stage provides isochronous acceleration of ions having non-relativistic velocities to the velocity at which relativistic effects begin to occur. The second stage further accelerates the ions into the relativistic velocity range while maintaining the same constant ion cyclotron frequency $\Omega(r°)$. In the first stage, the ions are injected at $\bar{r}^{in}$ with a velocity $V_\theta^{in}$ where $r^{in}$ is greater than $r^C$ (the radius of the central coil 14) but less than r° (the radius of the absolute-minimum-field circle. The ion source (not shown) may be any conventional device which can provide a monoenergetic ion beam with the velocity $V_\theta^{in}$ such as an ion injecting gun or a tandem Van de Graaff generator. In fact, a conventional cyclotron may provide the primary ion beam. In this case, the conventional cyclotron may be centrally located inside the central coil 14 of the solenoid. Positive ions are injected and accelerated in the direction opposite to that of $\underset{\sim}{J}^E$ as indicated by arrows 23. The ions, which are boosted and spiraled by $F_\theta^P$ and $F_r^E$, respectively, are axially and radially focused by the slowly decreasing $\underset{\sim}{B}_z^E$ (r,z=0)$\sim\bar{r}^{(\epsilon-1)}$ (where the field index, $\epsilon$, is less than one but greater than zero) as in the case of the conventional cyclotron. After having gained MeV kinetic energy, $T\equiv\epsilon-m_oC^2$, with a positive time rate, $\dot{T}=\dot{\epsilon}=m_oC^2\dot{\gamma}=q(\underset{\sim}{V}\cdot\underset{\sim}{E}^P)>0$, the ion arrives at the absolute minimum $B_z^E(r°,z=0)$ at radius r°. Here T is the kinetic energy, $\epsilon$ is the total energy, $m_o$ is the rest mass, C is the speed of light, $\gamma$ is the relativistic mass factor, and the superscript dot indicates the time derivative d/dt. The radius r° marks the end of the first stage and the beginning of the second stage.

Figure 2A:
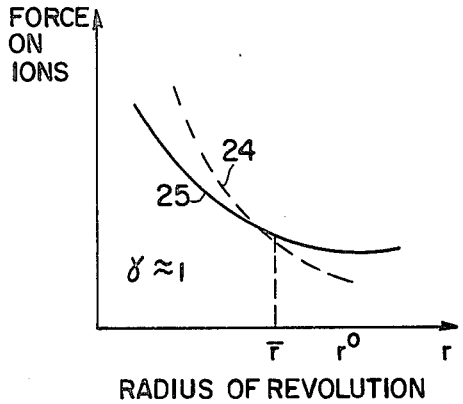
FIG. 2*a* illustrates the focusing concept used in a conventional cyclotron.
Figure 2B:
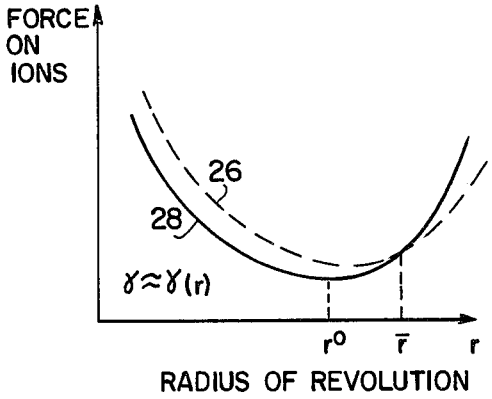
FIG. 2*b* illustrates the focusing concept used in the present invention.

As ions are further accelerated in the second stage (which goes beyond the conventional cyclotron), the relativistic mass increase $m_o\gamma$ due to the additional acceleration is matched by the radially-increasing $B_z^E$ (r>r°, z=0) so that the ion cyclotron frequency, $\Omega(r)\equiv(qB_z)/m_oC\gamma$, is constant for all r. As will be shown hereinafter, this isochronous characteristic allows a fixed-frequency power supply (in cooperation with radially-directed long horns which provide resonant cavities) to accelerate the MeV ions to GeV energies continuously in a phase-stable region. When $B_z^E$ increases radially, the orbital radius $\bar{r}=(m_o\gamma|V_\theta|C)/qB_z^E=[T(T+2m_oC^2)]^{\frac{1}{2}}/qB_z^E\approx T/qB_z^E$ is relatively reduced since T also increases radially. When $\dot{\gamma}$ is zero $\bar{r}$ $B_z^E\approx T/q\approx$constant if and only if $\bar{r}\approx T/B_z^Eq\approx$constant. The former relationship is used in the conventional cyclotron to weakly focus deviant ions by a radially-decreasing $B_z^E$ as shown in FIG. 2*a* where dashed line 24 and solid line 25 indicate the variation of centrifugal force and the Lorentz force with the ion radius of revolution. The latter relationship ($\bar{r}\approx T/B_z^Eq$) is used in the present two-stage cyclotron to focus the ions as shown in FIG. 2*b* where the dashed line 26 and solid line 28 indicate the variation of the centrifugal force and Lorentz force with the ion radius of revolution.

In an actual cyclotron, the solenoid preferably has additional pairs of superconducting coils disposed symmetrically between end coils 10 and 12 to provide increased field strength and more precise tailoring of the field contours. Typically, the design of the solenoid will be computer calculated based on the desired characteristics for r° (the location and the strength of the absolute minimum field) and the desired variation of $B^E$ as a function of r for the particular application. The basic design of the solenoid may be defined in cartesian coordinates by $$X=R\cos\theta;\ Y=R\sin\theta;\ Z=Q(\theta/2\pi);\ 0\leqq\theta\leqq2\pi L \quad (1)$$

$$R=r^C+|Z|^G;\ -1<Z<1 \quad (2)$$

where

R is the radius at angle $\theta$,

Z is the normalized axial displacement,

L is an odd integer greater than or equal to 3,

G is an index which quantifies the rate of change of R as R increases from $r^C$ to $r^M$, and Q is the axial spacing for each coil.

In the real mode eqn (1) describes a helix having the pitch Q. If $(\theta/2\pi)$ is truncated to an integer mode, then eqn (1) describes precisely L circular coils having the intercoil spacing of $Q=2/(L-1)$. It is noted that the coils are not required to be discrete, but that this design is preferable. The symmetry and the nearly parallel turns necessary to provide the absolute-minimum-field circle are very difficult to obtain in a continous helical solenoid. In addition, discrete coils are preferred because the current in the individual coils may be easily adjusted to compensate for errors in solenoid symmetry.

The accelerating structure includes several (six and shown for purposes of illustration) radially-directed metallic resonator horns 30 having the general proportions $2\,\Delta r >> 2\,\Delta z > r\theta$ where $2\,\Delta r$, $2\,\Delta z$, and $r\theta$ are the relative changes in length, height, and width as shown in FIG. 1. Only one horn 30*a* is shown in its entirety. These horns 30 are symmetrically positioned in the central plane outside the central coil 14 and uniformly spaced relative to and around the z-axis. The resonator horns 30 have slits 32 along both sides at $z=0$ (the orbital plane) from $r=r^{in}$ to $r^{out}$ where $r^{in}$ and $r^{out}$ are the radius at which the ions are injected into the cyclotron and the radius at which the ions are extracted from the cyclotron, respectively. A fixed-frequency power supply is attached to the resonator horns 30 for the purpose of providing the accelerating (boosting) electric field $E_\theta{}^P$ within the horn cavity. The subscript $\theta$ indicates that the electric field is in the $\theta$ direction, i.e., directed tangentially to the ion orbit. The slit 32 allow the orbiting ions to pass through the horns and the accelerating electric field $E_\theta{}^P$ which is present in the horn cavities. This power supply may be a magnetron 34 located at the center of the solenoid having a central cathode 36 surrounded by anodes 38 and anode cavities 40. The boosting field $E_\theta{}^P$ comes from magnetron radiation produced during radial acceleration of electrons 42 which are gyrated and precessed along a circle on the orbital plane under the magnetron crossfields $E_r{}^P \times B_z{}^P$ at $z=0$. The RF radiation is guided around the solenoid coils (for example central coil 14) and into the resonator horns 30 by contoured waveguides (not shown). Alternatively, each resonator may be individually driven by separate, synchronized Klystron amplifiers (as shown at 44 for example) which provide the boosting field $E_\theta{}^P$ and which are peripherally located, i.e., the Klystrons are coupled to the outer end of the radially-directed horns. In each alternative, the end of the horn 30 which is not coupled to the power supply (the outer end in the case of the centrally-located magnetron or the inner end in the case of the peripherally-located Klystron) is terminated so that a standing wave at a constant frequency $\omega$ is created in the horn cavity. The use of peripherally-located Klystron amplifiers is particularly useful if the initial ion beam is provided by a centrally-located conventional cyclotron. In either alternative the resonator horns 30 should be designed so that the magnitude of the electric field $E_\theta{}^P$ increases radially in second stage to reinforce focusing during acceleration. Preferably, the cavity may be one complete wavelength with the ion being accelerated in the first quadrant (the rising portion of the sinusoidal standing wave).

For radially matched booster and solenoid fields which will be specified hereinafter, the new cyclotron can accelerate the inertial mass $m_o\gamma$ and $|V_\theta| \equiv |\dot{r}_\theta| << C$ at a suitably chosen constant $\dot{\theta} = -\Omega$ toward a radially increased kinetic energy $T(r) = [1 - r^2(\Omega/C)^2]^{-\frac{1}{2}} m_o C^2 << T(\Omega/C)$. According to the principle of phase stability proposed by McMillian and Veksler and utilized in synchrotrons, phase stability requires a radially—increasing field which is provided in the case of a magnetron boosting supply when $$E_\theta{}^P = E_0 \sin(kr) \sin \theta^P(t)$$
$$\pi/2 > \theta^P(t) > 0 \qquad (3)$$
$$\pi/2 > kr > 0$$

Here $\theta^P(t) \equiv (w - P\dot{\theta})t$ is the phase that an ion is accelerated through P radial cavities per $2\pi$ radians, k is the wave number, w is the magnetron frequency, and $E_o$ is the electric field at r°.

If the magnetron is operated at a higher frequency w than the integer P times ion-revolving frequency $\theta$, the acceleration phase has the stability provided by the positive slope $\theta$, $\pi/2 > \theta^P(t) > -\pi/2$. Since the mean-free-time $\Delta t$ of an ion revolving with $\theta$ from one resonant cavity to an other is $|\dot{\theta}|\Delta t \approx 2\pi/P$ for P cavities per $2\pi$, then a slight undermatch of $\Delta t = 2\pi/P|\dot{\theta}|$ with the magnetron period $2\pi/|w|$, i.e. $w > P\dot{\theta}$, ensures that the ion will be continously accelerated in the positive boosting fields inside all the cavities. Since it is required that $\dot{\theta}(r) = -\Omega = \text{constant}$, then $|w| > P\Omega = \text{constant}$ is easily satisfied. An ion with $|\dot{\theta}| \geqq \Omega(r)$, arriving earlier at the resonant cavities at a certain radius r, is accelerated slightly faster due to the positive field slope with respect to the time; but because it becomes slightly heavier than $m_o\gamma(r)$ by gaining a bit more energy ($\leqq eV$), the ion having the angular velocity $|\dot{\theta}| \leqq \Omega(r)$ is late in arriving at the remaining cavities at r, and therefore receives less boosting energy. Such a natural balance makes the ion phase $\theta^P(t)$ migrate stably back and forth along the positive slope of the magnetron fields. Thus having chosen the constant frequency $w > P\dot{\theta} = \text{constant}$ (for example $P=6$), the phase stability is incorporated into eqn. (3) inside six resonators, that have been centrally fed from six anode cavities at 60° apart inside the magnetron. One distinct advantage in adopting a magnetron having a TE mode, instead of many Klystrons having a TM mode, is that a single radiation source can form a standing wave at the constant w. This is technically known as the $\pi$ mode, when the major anode cavities are separated by the distance $d = \pi/k$ apart, inside the so-called rising sun magnetron, or the wire strapped or unstrapped magnetron. Whichever magnetron is used, both the efficiency and the power level may be improved beyond the present microwave capacity toward the longer wave length and better mode separation required here. Otherwise, the synchronized Klystrons having the $|w| > P\Omega$ can equally feed six resonators with the field specified by eqn. (3).

Figure 3:
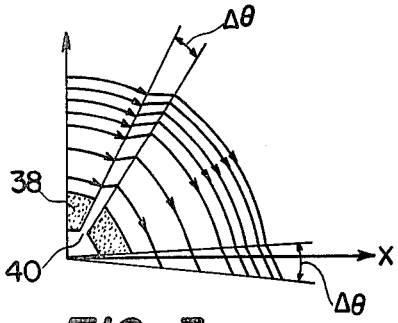
FIGS. 3, 4 and 5 illustrate the isochronous orbit of the present invention.

FIG. 3 illustrates the acceleration of the ions inside and outside the resonator horns 30 (only a single quadrant is shown). When the ions are in the resonator horns 30 the boosting field accelerates the ions to a new orbit. When the ions are not in the horns 30, they are screened by the metal walls of the resonator horn from the electric field $E_\theta^P$ but are focused into their orbits by the magnetic forces. Thus the ions are boosted in the cavities of width $r\Delta\theta$ and are free-coasting in the magnetic field alone in the regions between the cavities.

The ion orbit may be found by integrating the well-known non-linear equations for the ion orbit in a plane (See the above cited article by Harold Szu, eqn. (1) and (7)). In order to decouple the plane orbit from wobbling about the plane, $V_z$ is assumed to be zero. This assumption is valid since the ions possess a decelerated and negligibly small writhing speed $|V_z c^{-1}| << |V_\theta c^{-1}|$, because of strong mirror focusing due to the mirror coils. Thus, setting $V_z \equiv 0$ and $V_r \equiv \dot{r}\theta$, $\nabla \cdot V \equiv 0$ for a single point ion, the radially centrifugal and the tangentially Coriolis' accelerations are as follows:

$$r\dot{\theta}^2 = -r\dot{\theta}\Omega + \dot{r}\dot{\gamma}/\gamma + \ddot{r} \quad 4(a)$$

$$2\dot{r}\dot{\theta} = \dot{r}\Omega + \Omega V_{os}[1-(r\dot{\theta}/c)^2] - r\ddot{\theta} \quad 4(b)$$

$$V_{os}/c = qE_\theta^P/\Omega M_o\gamma c \equiv E_\theta^P(r,t)/B_z^E(r). \quad 4(c)$$

Figure 4:
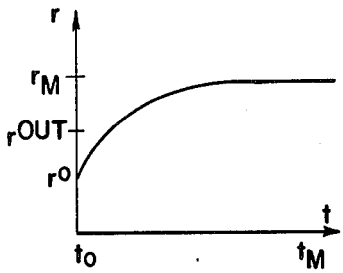
Figure 5:
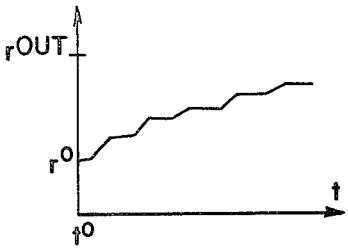

By definition, the radial quiver velocity $V_{os}$ is independent of $q/m_o$, the charge-mass ratio. Thus for a fixed $\Omega$, eqns. (4a, 4b, 4c) became independent of species. This allows the acceleration of various species tunable to an identical $\Omega(r^\circ)$ along a universal orbit as shown in FIG. 4. (for the second stage of acceleration). The time rate of an ion travelling on the universal orbit depends on the species and is given by $q|E_\theta^P|m_o c$ radians per second. The orbit is precisely a staircase built on a plane spiral having a gradually reduced radius as shown in FIG. 5. Because the fundamental requirement ($\ddot{\theta} \equiv 0$, $\dot{\theta} \equiv$ constant) must be satisfied during both accelerations and revolutions, it can be shown that $$\ddot{r}/\dot{r} \equiv -\dot{\gamma}/\gamma;\ \ddot{r} > 0;\ \dot{r} < 0;\ \dot{\gamma} > 0$$

$$\ddot{r}/\dot{r} \equiv -\dot{\gamma}/\gamma;\ \ddot{r} < 0,\ \dot{r} > 0;\ \dot{\gamma} > 0$$

$$r/c = \text{constant}\ \gamma^{-1} = \text{constant}\ [1-(r/\Omega C)^2]^{\frac{1}{2}}$$

(See the cited article for a complete derivation of the foregoing relationship.) From these relationships the following design criteria for $B_z^E(r)$ and $E_\theta^P(r,t)$ are obtained.

$$B_z^E(r) = B_z^E(r^0)[1-(r^0/r_M)^2]^{\frac{1}{2}}[1-(r/r_M)^2]^{-\frac{1}{2}} \quad (5)$$

$$E_\theta^P(r,t) = E_\theta^P(r^0 t)[1-(r^0/r_M)^2][1-(r/r_M)^2]^{-1} \quad (6)$$

Figure 6:
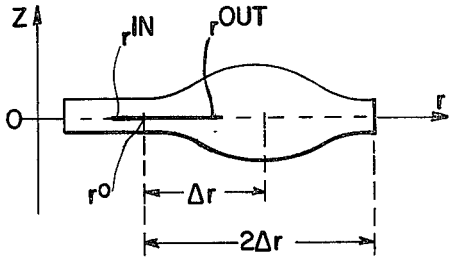
FIG. 6 illustrates the flare height of the resonator horns which enhances focusing of the ions into stable orbits.

Here $r_M \equiv c/\Omega$ is the maximally attainable radius of an ion according to the special relativity, $r\Omega$ c. Note that the heavier the ion mass the smaller the $\Omega$, and therefore, the larger the $r_M$. Since $r << r_M$ the Taylor expansion in $(r/r_M)$ can match the booster criterion of eqn. (6) with the already increased booster field of eqn. (3) by making the height 2 $\Delta z$ of the resonator 30 (2 $\Delta r >> 2\Delta z > r\Delta\theta$) flare out like a parabola horn as illustrated in FIG. 6.

$$\Delta z(r) = (\Delta z(r^0)/kr)[1+a(r/r_M)^2] \quad (7)$$

$$E_\theta^P(r,t) = E_\theta^P(r^0,t)[\Delta z(r)/\Delta z(r^0)]\sin(kr) \quad (8)$$

Here the constant $a \geqq 1$ can be varied to give the best Pade' fit between eqns. (3) and (6) over the domain:

$$\pi/2 \approx kr > kr^0,\ k = \pi/2\ \Delta r \text{ and } kr_M >> \pi/2.$$

The new orbit at the second stage, i.e., for $r_M \geqq r \geqq r^0$, may be shown to be (in the limit where $P\Delta\theta = 2\pi$)

$$r(t) = r_M[1-(r^0/r_M)^2]^{-\frac{1}{2}} \sin[(A(t-t^0)] + r^0 \cos[A(t-t^0)] \quad (9a)$$

$$A = q|E_\theta^P(r^0)|/m_o c \quad (9b)$$

$$t_M^A - t^0 = [(\pi/2) - \sin^{-1}(r^0/r_M]A^{-1} \quad (9c)$$

where $t^0$ is the time when the ion is at $r^0$, and $t_M^A$ is time at which a species reaches the maximum orbit.

In the present case $P\Delta\theta < 2\pi$, the complete orbit consists of shielded revolutions ($\dot{r} = \ddot{r} = 0$) outside $P\Delta\theta$ and of boosted accelerations ($\dot{r} > 0$, $\ddot{r} < 0$) inside $P\Delta\theta$. This complete orbit (FIG. 5) is obtained by slicing vertically the continuous curve in FIG. 4 into equal pieces of the length $\Delta t^A = \Delta\theta/\Omega$ due to the constant angular frequency inside each booster of the angular width $\Delta\theta$, and then connecting each piece with a flat line of the length $\Delta t^R = (2\pi - P\Delta\theta)/P$ due to rotations ($\dot{r} = \ddot{r} = 0$) with the constant $\Omega$ inside P shielded regions. A different species has a different time rate. The total time span required for the complete orbit is bounded by the absolute maximum $t_M^A - t^0$ multiplied with the proportional factor $[(2\pi - P\Delta\theta) + P\Delta\theta]/P\Delta\theta = 2\pi/P\Delta\theta$.

The reader is referred to the above-cited publication for a rigorous proof that the solenoid coil and the accelerating structure of the present cyclotron provide an ion orbit (in the second stage) focused radially, axially, and angularly by the synergistic effects of the radially-increasing magnetic field and the radially-increasing boosting field. It is noted that conventional focusing techniques (weak focusing) are used in the first stage. The effects of the ion self-field and Coulomb collisions are also shown not to harm the orbital stability of the present cyclotron due to the massiveness of the ion and the mirror magnetic field, respectively.

The practicality of the present cyclotron may be demonstrated by a comparison with a conventional cyclotron. Consider the case where it is desired to accelerate a heavy ion to energies in the range of 10 to 100 GeV as has been suggested for use in thermonuclear power generation. In the first stage where $\gamma$ is approximately one, $B_z^E(r < r^\circ)$ is proportional to $r^{-0.7}$ from conventional cyclotron experience. At the second stage for $1 < \gamma < (1+K)$, where K is the accelerated kinetic energy in units of rest mass energy $m_0C^2$, the larger the ions' rest mass the smaller the change of cyclotron frequency $\Omega(r) \equiv qB_z/m_0\gamma C$. Since by definition $\gamma = K+1$, a small K is required to accelerate a heavy ion. For example, $K \approx 0.45$ is required to accelerate a $U^{238}$ ion which has a large rest mass (223 GeV) to a kinetic energy of 100 GeV. Since the last factor of Eq (5) is by definition $\gamma = K+1$, the finite increase of coil field in the second stage is bounded by $B_z^E(r) \leqq (K+1)B_z^E(r^0)$. Similarly from Eq (6) it follows that the finite increase in the resonator field is bounded by $$E_\theta^P(r) \leqq (K+1)^2 E_\theta^P(r^0).$$

Here the radial increases are compared with those conventional cyclotron fields $B_z^E(r^0)$ and $E_\theta^P(r^0)$ used for $T \leqq 1\%\ m_0C^2$ at the first stage of acceleration. Furthermore, the radiation loss ($\sim K^4$) becomes negligible for heavier ions.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. In an isochronous cyclotron of frequency $\Omega$ of the type in which ions are injected at an initial energy at radius $r^{in}$ and non-relativistic velocity $V_\theta^{in}$ in the orbital plane, focused in a curvilinear orbit by a magnetic field, and accelerated to a final energy and a relativistic velocity $V_\theta^{out}$ at radius $r^{out}$, the combination comprising:

means for providing a magnetic field having an absolute minimum intensity at a circle radius $r^\circ$ greater than $r^{in}$ in the orbital plane, said means comprising an electric solenoid having a central radius $r^C$ in the orbital plane where $r^C$ is less than $r^{in}$ and having end radii $r^M$ equidistant from $r^C$ where $r^M$ is greater than $r^C$; and means for accelerating said ions comprising means for producing an electric field directed tangentially to the orbit of said ions, and at least one radially-directed resonator horn coupled to said electric-field-producing means, said resonator horn confining said tangentially-directed electric field within said horn, said horn having means for allowing the orbiting ions to pass through said electric field within said horn.

2. The combination as recited in claim 1 wherein said solenoid comprises at least three, discrete, circular, coaxial, superconducting coils.

3. The combination as recited in claim 1 wherein the intensity of said magnetic field produced by said solenoid varies outwardly in the orbital plane from the circle of absolute-minimum field intensity according to the expression $$B_z^E(r^\circ)[1-(r^\circ/r_M)^2\pi[1-(r/r_M)]^{-\frac{1}{2}}$$

where $B_z^E(r^\circ)$ is the intensity of the axial component of the magnetic field at $r^\circ$, and $r_M$ is defined by $c/\Omega$ where c is the velocity of light.

4. The combination as recited in claim 1 wherein said electric-field-producing means means coupled to said resonator horn is a magnetron coupled to the inner end of said radially-directed horn.

5. The combination as recited in claim 1 wherein said electric-field-producing means means is a Klystron amplifier coupled to the outer end of said radially-directed horn.

6. The combination as recited in claim 1 wherein the resonator horn is shaped to provide a radially-increasing electric-field intensity within said horn between $r^\circ$ and $r^{out}$.

7. The combination as recited in claim 1 wherein the intensity as a function of time of the electric field at radius r varies outwardly from the circle of absolute-minimum field intensity according to the expression $$E_\theta^P(r^\circ,t)[1-(r^\circ/r_M)^2][1-(r/r_M)^2]^{-1}$$

where $E_\theta^P(r^\circ, t)$ is the electric field intensity at radius $r^\circ$ as a function of time, $r_M$ is $c/\Omega$, and c is the velocity of light.

* * * * *